US007941069B2

(12) United States Patent
Idehara et al.

(10) Patent No.: US 7,941,069 B2
(45) Date of Patent: May 10, 2011

(54) PROCESS CARTRIDGE HAVING AIR INLETS AND OUTLETS FOR COOLING GEARS DISPOSED IN THE PROCESS CARTRIDGE

(75) Inventors: Ryoh Idehara, Hyogo (JP); Nobuhiko Kita, Osaka (JP); Sei Onuma, Osaka (JP); Kazuyoshi Kondo, Osaka (JP); Yuusuke Furuichi, Osaka (JP); Tadashi Okano, Ibaraki (JP); Genta Hagiwara, Osaka (JP); Kaoru Tada, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 407 days.

(21) Appl. No.: 11/853,534

(22) Filed: Sep. 11, 2007

(65) Prior Publication Data

US 2008/0063425 A1 Mar. 13, 2008

(30) Foreign Application Priority Data

Sep. 12, 2006 (JP) ..... 2006-246681
Dec. 20, 2006 (JP) ..... 2006-342912

(51) Int. Cl.
*G03G 21/20* (2006.01)

(52) U.S. Cl. ..... 399/92

(58) Field of Classification Search ..... 399/92, 399/93

See application file for complete search history.

(56) References Cited

U.S. PATENT DOCUMENTS

D322,279 S 12/1991 Tsutsui
D365,845 S 1/1996 Yasuda et al.
D580,968 S 11/2008 Tatsumi et al.
D590,011 S 4/2009 Tatsumi et al.
D590,012 S 4/2009 Tatsumi et al.
D597,129 S 7/2009 Tatsumi et al.
D603,450 S 11/2009 Tatsumi et al.
2004/0120727 A1* 6/2004 Komatsubara ..... 399/92
2006/0245787 A1* 11/2006 Ito et al. ..... 399/111

FOREIGN PATENT DOCUMENTS

JP 03103869 A * 4/1991
JP 2000-98855 4/2000
JP 2002023597 A * 1/2002
JP 2003-57927 2/2003
JP 2003-114577 4/2003
JP 2003-280496 10/2003
JP 2003-323034 11/2003
JP 2005017939 A * 1/2005
JP 2005090574 A * 4/2005
JP 2005-148102 6/2005
JP 2005-173226 6/2005
JP 2005-258316 9/2005
JP 2005258316 A * 9/2005
JP 2006017813 A * 1/2006

OTHER PUBLICATIONS

Machine English Translation of JP2002023597.*
Machine English Translation of JP2005017939.*
Machine English Translation of JP2005258316.*
Machine English Translation of JP2005-090574.*

* cited by examiner

*Primary Examiner* — David M Gray
*Assistant Examiner* — Billy J Lactaoen
(74) *Attorney, Agent, or Firm* — Oblon, Spivak, McClelland, Maier & Neustadt, L.L.P.

(57) ABSTRACT

A process cartridge includes a photoconductor driven by gears, a developing roller, an agitator. The process cartridge is mounted on an image forming apparatus that forms an image with toner. The process cartridge includes an air inlet and an air outlet on a side plate thereof. The gears are arranged along a path between the air inlet and the air outlet.

18 Claims, 18 Drawing Sheets

PROCESS CARTRIDGE HAVING AIR INLETS AND OUTLETS FOR COOLING GEARS DISPOSED IN THE PROCESS CARTRIDGE

CROSS-REFERENCE TO RELATED APPLICATIONS

The present application claims priority to and incorporates by reference the entire contents of Japanese priority documents, 2006-246681 filed in Japan on Sep. 12, 2006 and 2006-342912 filed in Japan on Dec. 20, 2006.

BACKGROUND OF THE INVENTION

1. Field of the Invention

The present invention relates to a process cartridge and an image forming apparatus.

2. Description of the Related Art

In recent years, colorization has been extensively applied to image forming apparatuses such as copiers, printers, facsimile machines, and multifunction products (MFPs) with a plurality of functions. Particularly, a tandem type that has a plurality of image bearing members excels in speed and is becoming a mainstream. In the tandem type image forming apparatus, an apparatus used by arranging four process cartridges in parallel is known. Because miniaturization of the apparatus is an element that directly leads to customers' convenience, the process cartridges are generally arranged closely as possible, or a space between other units are narrowed.

On the other hand, to meet demands for energy savings, a method of lowering temperature required for a heat-fixing unit by lowering a toner melting temperature is generally used to reduce power consumption.

Accordingly, these make it difficult to remove heat caused by self-heating of the process cartridge, due to a small number of spaces. Further, the toner apt to melt due to the self-heating is susceptible to damage.

The self-heating of the process cartridge is largely caused by frictional heat in a developing roller unit due to sliding and friction with a restricting blade, and sliding frictional heat in a drive transmission. Because the drive transmission is generally gathered to one side of the cartridge, the generation of heat in the drive transmission causes by temperature deviation.

To reduce such a problem, Japanese Patent Application Laid-Open No. 2005-258316 discloses a conventional technology for ventilation within a space where gears are stored, thereby suppressing a temperature rise within the process cartridge. Japanese Patent Application Laid-Open No. 2005-173226 discloses another conventional technology for ventilation in which an air duct is provided in a hollow portion formed by a developer restricting member and a developing frame body.

However, the former conventional technology increases the size of the apparatus. With the latter conventional technology, the process cartridge is formed in a substantially rectangular shape and ventilated in a longitudinal direction to be cooled. This causes a rise in the temperature at a downstream side, resulting in temperature deviation.

SUMMARY OF THE INVENTION

It is an object of the present invention to at least partially solve the problems in the conventional technology.

According to an aspect of the present invention, a process cartridge for an image forming apparatus includes a rotator; a gear that drives the rotator; an air inlet; and an air outlet. A path is formed between the air inlet and the air outlet where the gear is located.

According to another aspect of the present invention, an image forming apparatus includes a process cartridge that is detachably mountable, and includes a rotator; a gear that drives the rotator; an air inlet; and an air outlet. A path is formed between the air inlet and the air outlet where the gear is located. The image forming apparatus further includes an intake opening that corresponds to the air inlet; an exhaust opening that corresponds to the air outlet; and a space that is substantially sealed and is communicated with outside via the intake opening and the exhaust opening.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below referring to the accompanying drawings.

Figure 1:
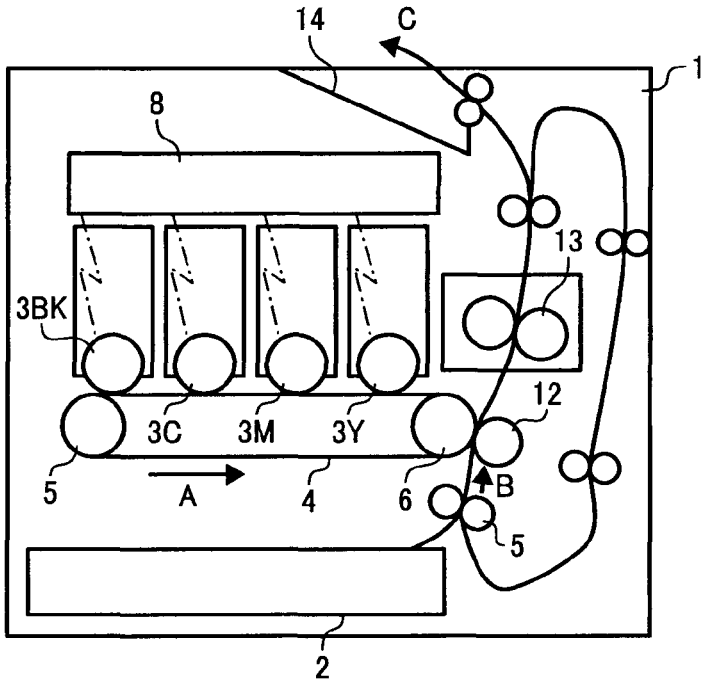
FIG. 1 is a schematic diagram of an image forming apparatus according to an embodiment of the present invention.

FIG. 1 is a schematic diagram of a color printer as an example of an image forming apparatus according to an embodiment of the present invention. The image forming apparatus includes a body 1 that accommodates therein four photoconductors 3Y, 3M, 3C, and 3BK for yellow, magenta, cyan, and black. These photoconductors 3Y, 3M, 3C, and 3BK are hereinafter collectively designated by the reference numeral 3 unless they are required to be differentiated. Although the photoconductors 3 as described herein are in a drum shape, they can be an endless belt. An intermediate transfer medium 4, which is an example of a transfer material, is arranged opposed to the photoconductors 3Y through 3BK. The intermediate transfer medium 4 shown here includes an endless belt wound around a plurality of supporting rollers 5 and 6, and movably driven in an arrow A direction. A color sequence of the photoconductors 3 can be different from the one arranged on the intermediate transfer medium 4 shown in FIG. 1.

The photoconductors 3Y to 3BK are of like configuration and operate in a similar manner, and thus but one of them, i.e., the photoconductor 3Y, is explained.

Figure 2:
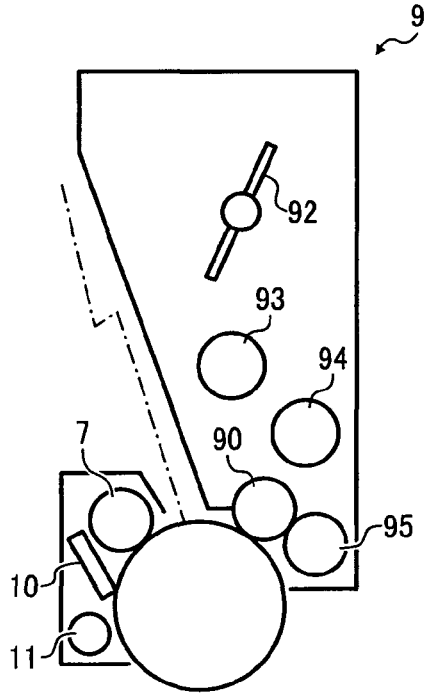
FIG. 2 is a schematic diagram of relevant parts of the image forming apparatus.

FIG. 2 is an enlarged view of the photoconductor 3Y, and the surroundings of the photoconductor 3Y. The photoconductor 3Y is rotatably driven in a clockwise direction in FIG. 2. A surface of the photoconductor 3Y is uniformly charged to a predetermined polarity by a charging roller 7. A surface of the charged photoconductor 3Y is irradiated with writing light (e.g., laser beam) L emitted from an exposing device 8. Accordingly, an electrostatic latent image is formed on the photoconductor 3Y, and then it is visualized as a yellow toner image by a developing device 9. The developing device 9 includes a developing roller 90, an agitator 92, agitating rollers 93 and 94, and a toner supply roller 95.

A transferring device (not shown) is arranged at a position opposed to the photoconductor 3Y, interposing the intermediate transfer medium 4 made of the endless belt therebetween. The yellow toner image on the photoconductor 3Y is transferred onto the intermediate transfer medium 4 by an action of the transferring device. A transfer residual toner remaining on the photoconductor 3Y, which is not transferred to the intermediate transfer medium 4, is removed by a cleaning device 10 having a cleaning device. The removed toner is conveyed to a waste toner tank (not shown) by a cleaning coil 11. A residual charge on the photoconductor 3Y is removed by a de-charger (not shown), and then the photoconductor 3Y waits for the next image formation.

Similarly, the magenta toner image, the cyan toner image, and the black toner image are formed on the photoconductors 3M, 3C, and 3BK, respectively. These toner images are sequentially transferred onto the intermediate transfer medium 4, and superimposed on the yellow toner image already transferred thereonto. Thus, a four-color toner image is formed on the intermediate transfer medium 4.

A sheet feeder 2 is arranged under the image forming body 1. From the sheet feeder 2, a recording medium such as a transfer sheet or a resin film is fed in a direction shown by an arrow B in FIG. 1. The recording medium is conveyed to a transfer region between a second transferring device 12 and the intermediate transfer medium 4. The toner image formed on the intermediate transfer medium 4 is transferred onto the recording medium by the second transferring device 12. The recording medium supporting the toner image transferred as such is sent to a fixing device 13, and passes through the fixing device 13. The toner image is fixed onto the recording medium by heat and pressure, thereby forming a full color image on the recording medium. The recording medium that passed through the fixing device 13 is discharged on a discharging unit 14 in a direction shown by an arrow C.

Figure 20:
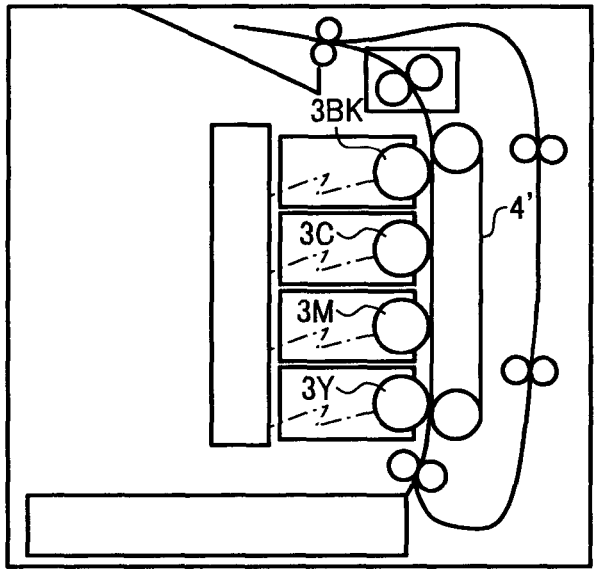
FIG. 20 is a schematic diagram of an image forming apparatus according to another embodiment of the present invention.

An integrated process cartridge 20 includes the photoconductor 3, the charging roller 7, the developing device 9, the cleaning device 10, and the de-charger. A plurality of, four in this example, the process cartridges 20 is mounted on the body 1. The process cartridges 20 are detachable by, for example, sliding. All the process cartridges 20 are of essentially the same configuration except for color of developer stored in the developing device. The image forming apparatus according to the embodiment can be of various types including the one that sequentially superimposes and transfers the toner images formed on the respective photoconductors 3Y, 3M, 3C, and 3BK to the recording medium conveyed on a transfer belt 4' as shown in FIG. 20.

Figure 3:
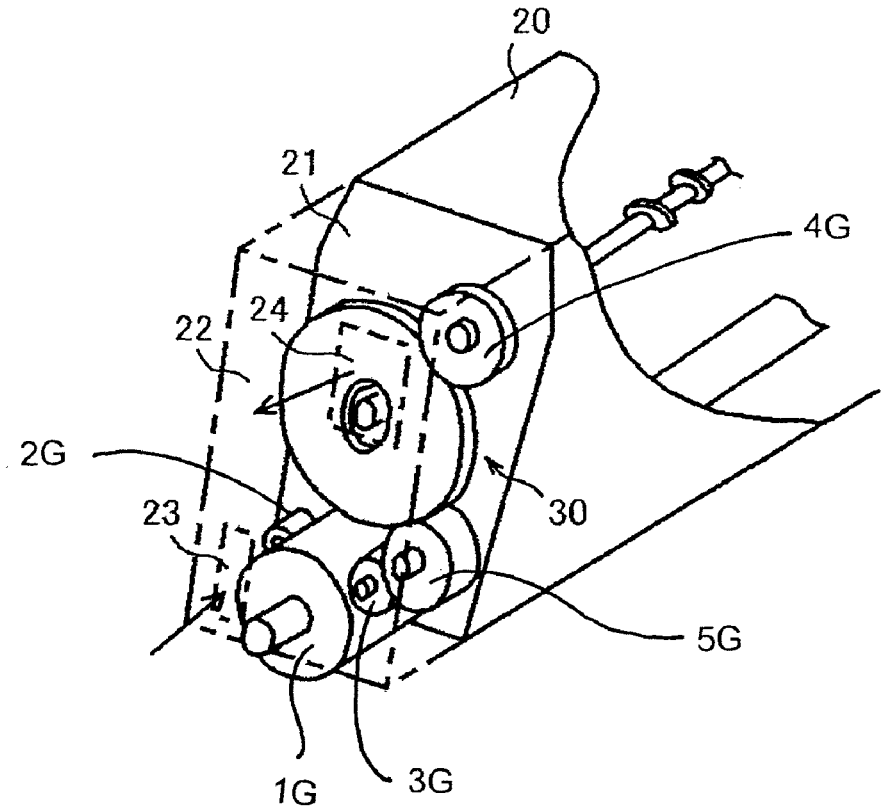
FIG. 3 is a perspective view of an example of a process cartridge of the image forming apparatus.

FIG. 3 is a schematic diagram for explaining drive transmission of the process cartridge 20. The photoconductor 3 that is a rotator and the developing device 9 in the process cartridge 20 are drivably connected to a drive-source interposing gears 30 included in the drive transmission therebetween. The developing device 9 includes the developing roller 90, the agitator 92, the agitating rollers 93 and 94, and the toner supply roller 95. In the process cartridge 20, due to a heavy load such as toner agitating, torque to the gears of the drive transmission is increased, which causes extra heat generation.

According to the embodiment, the drive transmission that has a large influence over a self-heating of the process cartridge is cooled without an adverse effect. This is explained below.

Figure 4:
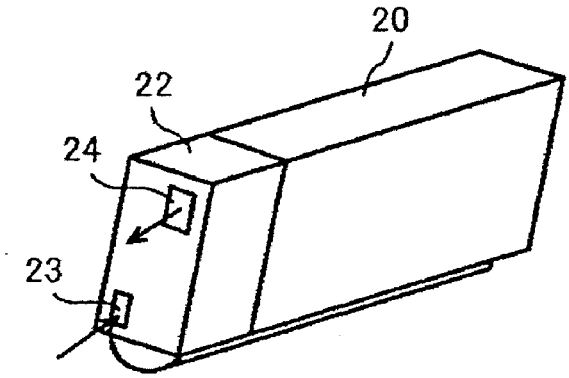
FIG. 4 is an external perspective view of the process cartridge shown in FIG. 3.
Figure 21:
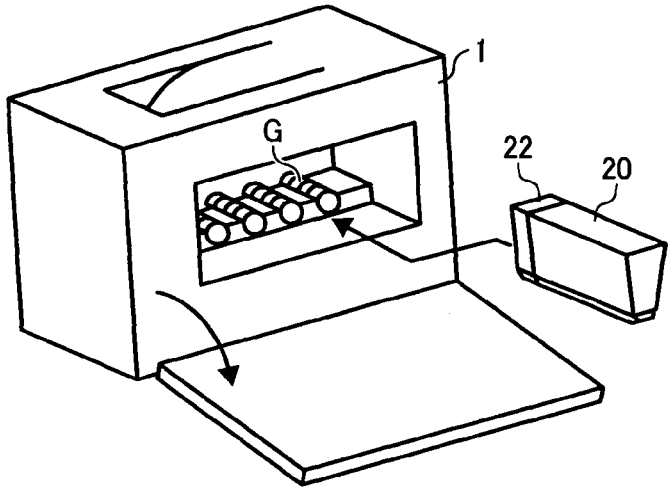
FIGS. 21 and 22 are schematic diagrams for explaining examples of how the process cartridge is mounted on the image forming apparatus.
Figure 22:
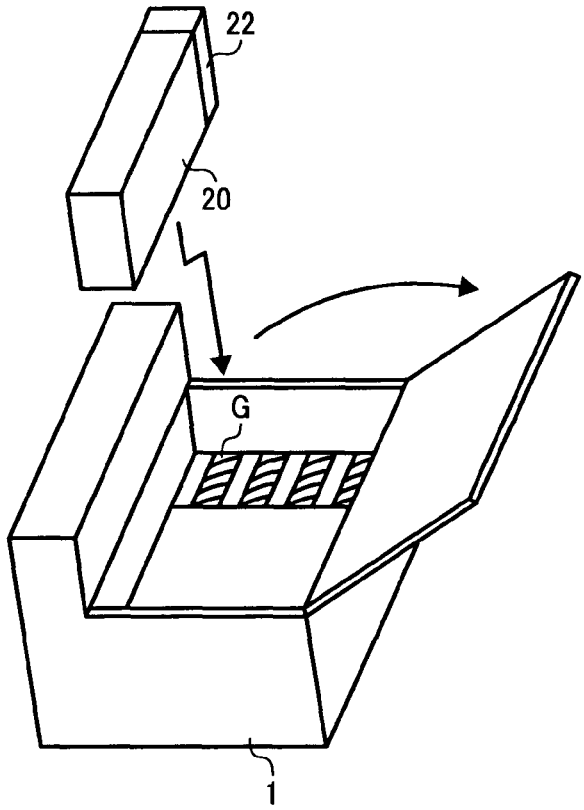

The gears 30 of the drive transmission including first gear (1G) configured to drive the photoconductor, a second gear (2G) configured to drive the charging roller, a third gear (3G) configured to drive the developing device, a fourth gear (4G) configured to drive the agitator, a fifth gear (5G) configured to drive the toner supply roller, as shown in FIG. 3, are provided at a side of the process cartridge 20, i.e., at a rear side of the process cartridge 20 being mounting on the body 1. When the process cartridge 20 is mounted correctly, as shown in FIG. 21, one gear of the gears 30 engages with a drive gear G. The gears 30 are provided outside a side wall 21 of the process cartridge 20. The gears 30 are covered by a side plate 22, and are housed in a gearbox. Further, as shown in FIGS. 3 and 4, an air inlet 23 and an air outlet 24 are provided at the side plate 22. Air enters in the gearbox from the air inlet 23, flows along the gears 30, and flows towards the air outlet 24. FIG. 21 depicts a type of the process cartridge 20 that is configured to be mounted on the body 1 by sliding in a substantially horizontal direction. FIG. 22 depicts a type of the process cartridge 20 that is configured to be mounted on the body 1 from the above. With the process cartridge 20 of FIG. 22, one gear of the gears 30 engages with the drive gear G at the rear side.

Figure 5:
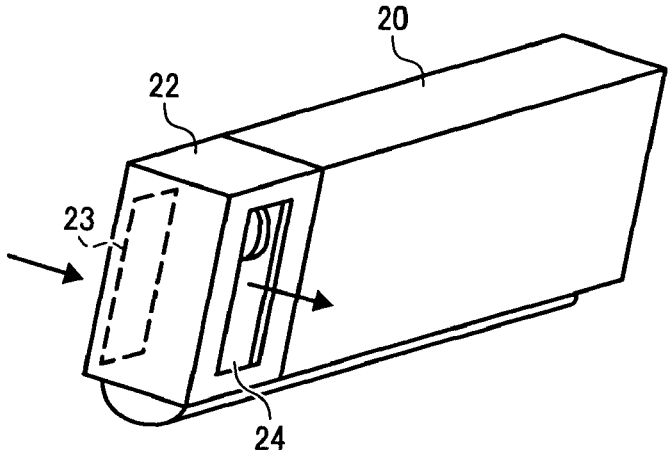
FIG. 5 is another example of a process cartridge of the image forming apparatus.

In FIGS. 3 and 4, the air inlet 23 and the air outlet 24 are provided to a surface orthogonal to a longitudinal direction of the process cartridge 20 shifted from each other. However, as shown in FIG. 5, the air inlet 23 and the air outlet 24 may be provided to opposing side surfaces of the side plate 22.

The process cartridge 20 formed as above can remove heat generated at gear engagement and a bearing sliding unit, thereby preventing problems such as toner deterioration and a fixation caused by heat.

Figure 6:
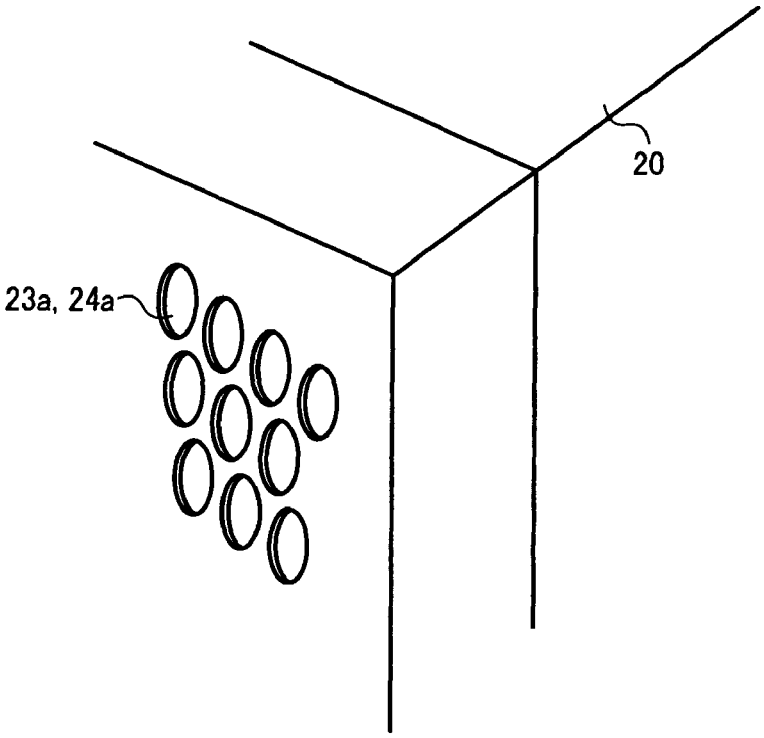
FIG. 6 is an example of an air outlet and an air inlet shown in FIG. 3.
Figure 7:
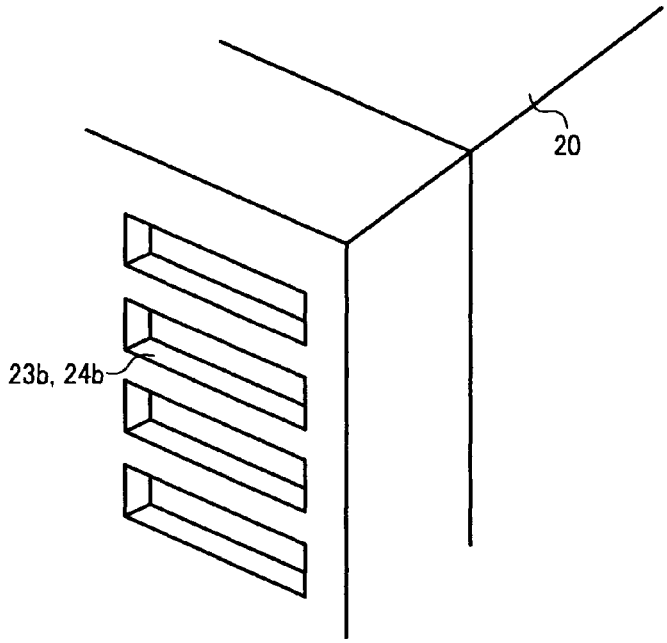
FIG. 7 is another example of an air outlet and an air inlet.

When the air inlet 23 and the air outlet 24 are formed by a collection of holes 122 and 24*a* as shown in FIG. 6, or slits 23*b* and 24*b* as shown in FIG. 7, the air can flow without a cartridge operator accidentally touching the gear while handling the process cartridge 20.

With this configuration in which the air inlet 23 or the air outlet 24 is formed by a collection of a plurality of holes, safety of the process cartridge operator can be improved without reducing an opening area by appropriately setting an individual opening size.

Figure 8:
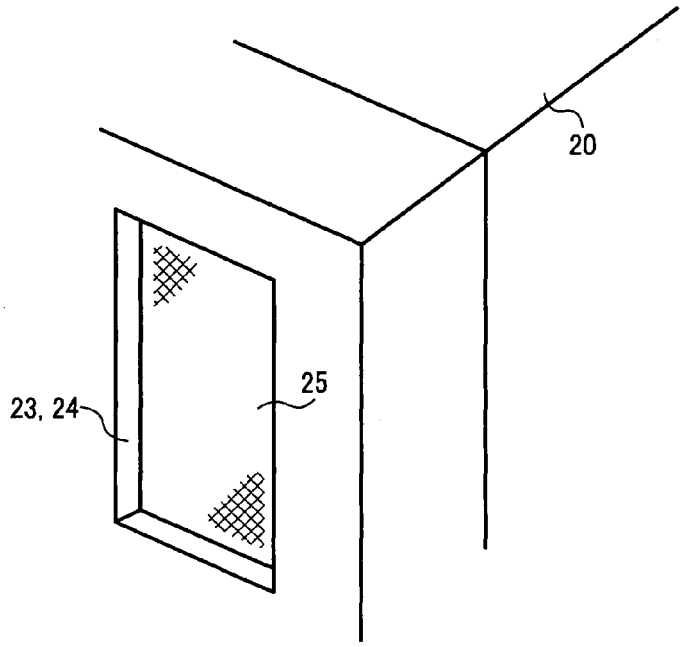
FIG. 8 is still another example of an air outlet and an air inlet.
Figure 9:
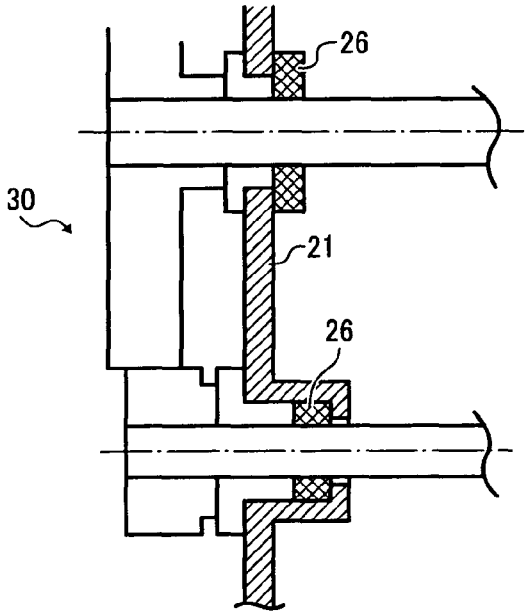
FIG. 9 is a cross section of part of a drive transmission.

When the air inlet 23 or the air outlet 24 is covered with a filter 25, as shown in FIG. 8, the operator does not accidentally touch the gear. Also, dust is prevented from entering the gearbox, and the dust and toner are prevented from being discharged outside of the process cartridge 20. Further, as shown in FIG. 9, by providing a seal 26 to an axis penetrating through the side wall 21, the toner within the process cartridge 20 is prevented from entering into the gearbox.

In such a configuration, air polluting substances such as dust and toner do not come out from the process cartridge 20.

Figure 10:
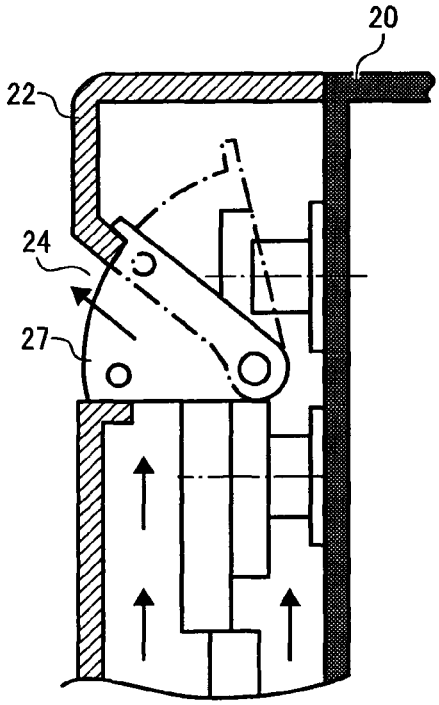
FIG. 10 is a cross section of still another example of an air outlet.

FIG. 10 is a cross section of another example of the air outlet 24. The air outlet 24 is provided with an openable and closable shielding member 27. When the shielding member 27 is closed, the operator is prevented from touching the gears. When the shielding member 27 is opened, an opening area is enlarged, whereby more air can be delivered safely.

Figure 11:
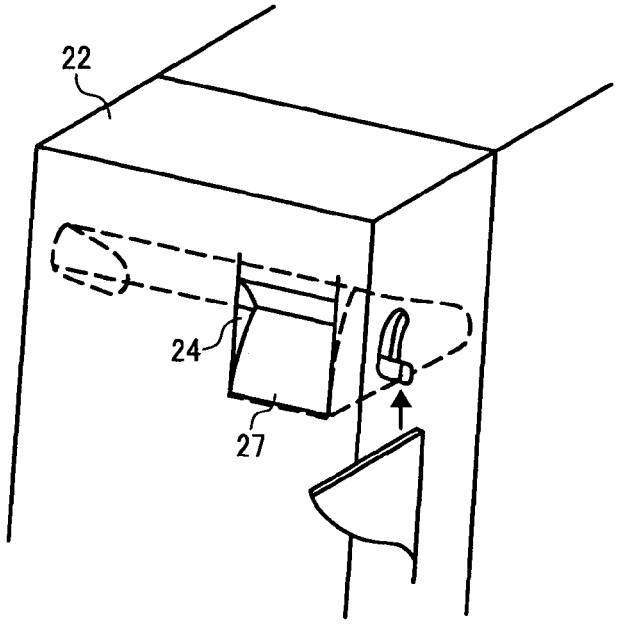
FIG. 11 is an external perspective view of the air outlet and the air inlet shown in FIG. 10.

The shielding member 27, as shown in FIG. 11, is configured to be open when part of the shielding member 27 abuts an operating unit provided on the body 1 while the process cartridge 20 is mounted on the image forming apparatus. A torsion spring and the like (not shown) are always arranged to the shielding member 27 in a closing direction Accordingly, the opening closes when the process cartridge 20 is removed, and the air outlet 24 opens when the process cartridge 20 is attached to the body 1 without any operation by the operator. The shielding member 27 can be provided to the air inlet 23 as well as to the air outlet 24.

It is preferable to arrange the air outlet 24 above the air inlet 23 in a gravity direction in a state that the process cartridge 20 is being set. In such an arrangement, the heat can also be removed by natural convection.

Figure 12:
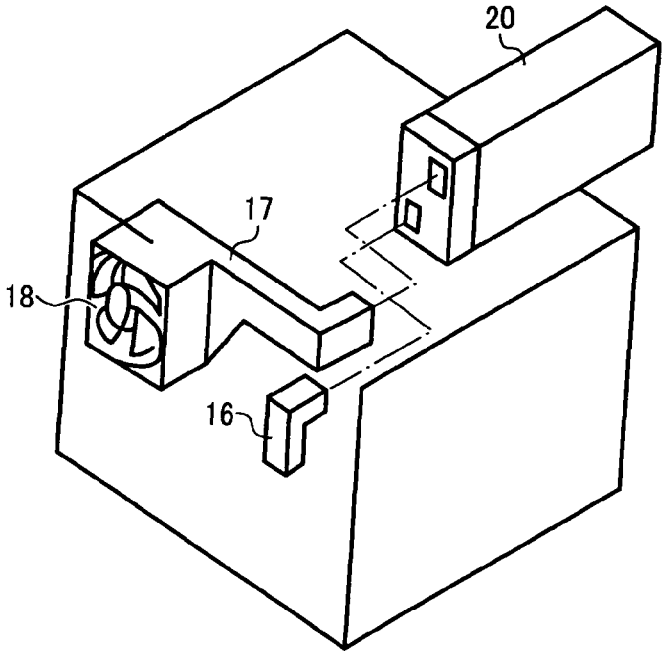
FIG. 12 is a perspective view of the process cartridge mounted on the image forming apparatus for explaining an arrangement of the air inlet and the air outlet.
Figure 13:
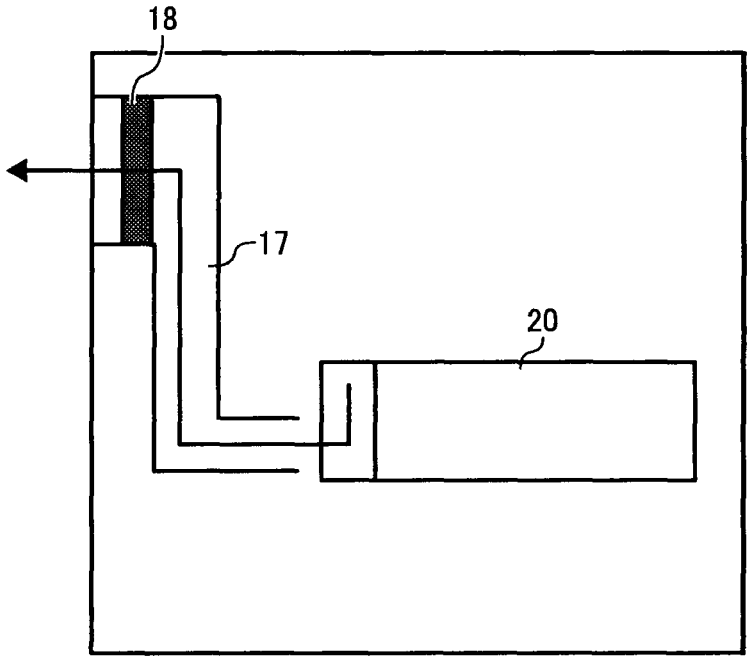
FIG. 13 is a plan view of the process cartridge shown in FIG. 12.

FIGS. 12 and 13 are schematic diagram of the process cartridge 20 mounted on the body 1.

In FIGS. 12 and 13, an air-supply side passage 16 and an air-exhaust side passage 17 are provided in the body 1. When the process cartridge 20 is mounted on the body 1, the passage 16 faces the air inlet 23, and the passage 17 faces the air outlet 24.

Figure 14:
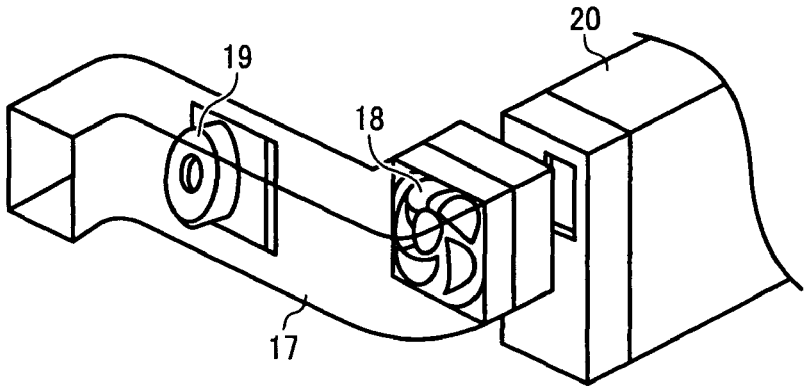
FIG. 14 is a perspective view the process cartridge mounted on the image forming apparatus for explaining another arrangement of the air inlet and the air outlet.
Figure 15:
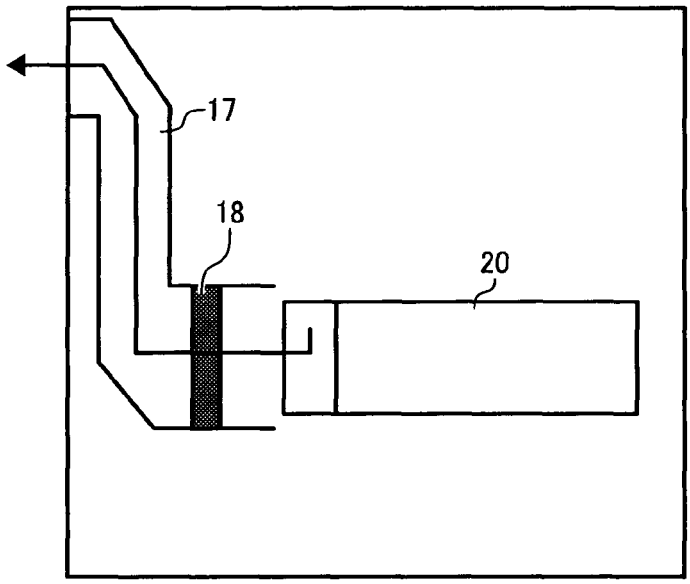
FIG. 15 is a plan view of the process cartridge shown in FIG. 14.

A fan motor 18 is provided to the passage 17. By operating the fan motor 18, the air flows within a cartridge drive transmission. The fan motor 18 may be arranged near the process cartridge 20 in the passage 17, as shown in FIGS. 14 and 15. This is preferable because an amount and speed of air flowing through the cartridge drive transmission can be improved.

Because an upper temperature limit of a cooled object is generally equal to or less than 50 degrees centigrade, it is natural to set the temperature of the air flowing through the drive transmission of the process cartridge 20 lower than that. The temperature is lower compared with the upper temperature limit of a motor or the fixing device 13 (80 to 100 degrees centigrade). With this configuration of the airflow passage as shown in FIG. 14, for example, a motor 19 can be cooled. Further, by arranging the fan motor 18 near the cartridge, airflow having a strong directivity (high flow velocity) can be delivered to the motor 19. As a result, the motor 19 can be cooled more effectively. The airflow can also be used to cool the fixing device 13 instead of the motor 19.

Figure 16:
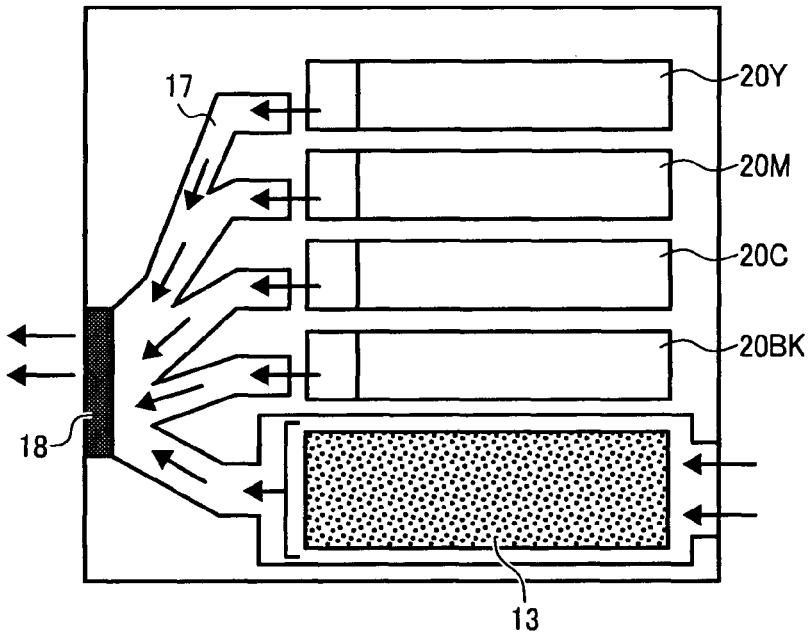
FIG. 16 is a plan view of the process cartridge mounted on a color image forming apparatus for explaining an arrangement of the air inlet and the air outlet.
Figure 17:
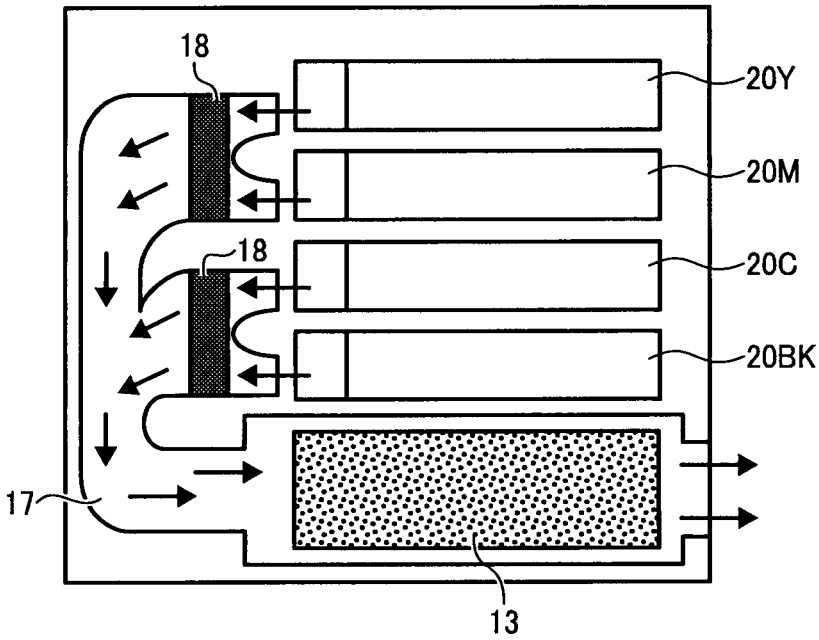
FIG. 17 is a plan view of the process cartridge mounted on the color image forming apparatus for explaining another arrangement of the air inlet and the air outlet.

To cool the fixing device 13 of a color image forming apparatus, as shown in FIG. 16, the fan motor 18 can be arranged after combining four process cartridges 20Y, 20M, 20C, and 20BK, and the passage 17 from the fixing device 13 into one. Or, as shown in FIG. 17, the airflow from the four process cartridges 20Y, 20M, 20C, and 20BK can be exhausted through the fixing device 13.

Figure 18:
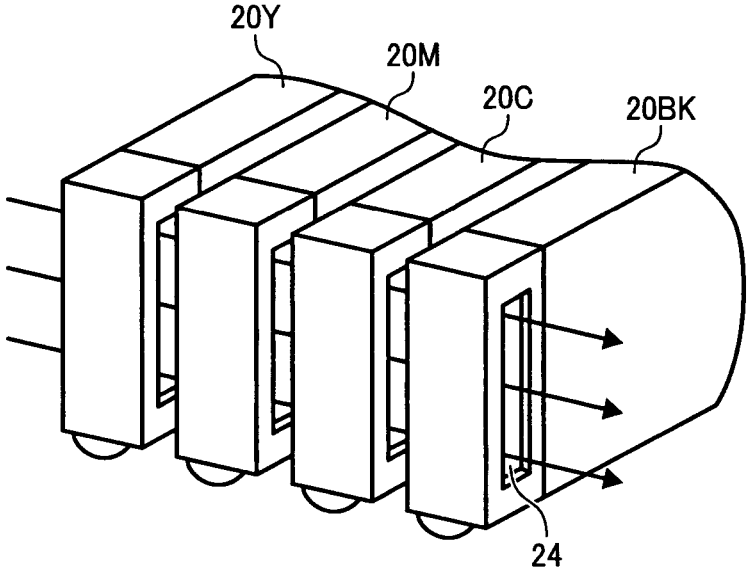
FIG. 18 is a schematic diagram for explaining an arrangement of the process cartridges on the color image forming apparatus.
Figure 19:
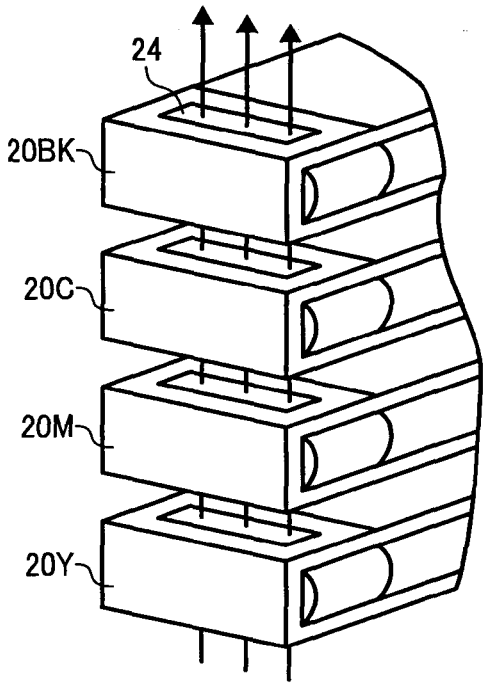
FIG. 19 is a schematic diagram for explaining another arrangement of the process cartridges on the color image forming apparatus.

In the color image forming apparatus, as shown in FIGS. 18 and 19, the four process cartridges 20Y, 20M, 20C, and 20BK that respectively form the yellow toner image, the magenta toner image, the cyan toner image, and the black toner image are closely arranged in parallel. Therefore, the four process cartridges 20Y, 20M, 20C, and 20BK may form an integrated passage, by opposing the air inlet 23 and the air outlet 24 provided to the respective process cartridges 20.

Because there is no need to prepare an individual passage to an individual inlet and outlet, a space-saving and low-cost can be realized.

Moreover, because an outlet is provided to an end of a side of the fixing device in a direction that the four process cartridges 20Y, 20M, 20C, and 20BK are arranged, the process cartridges and the fixing device can be sequentially cooled within a small space. Also, by arranging the fixing device on downstream of the airflow passage, a process cartridge driving unit can be less influenced by the fixing device.

Figure 23:
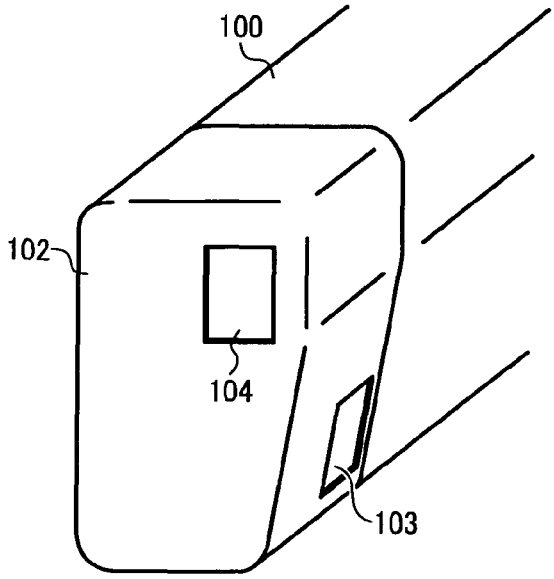
FIGS. 23 and 24 are perspective views of an air outlet and an air inlet of a process cartridge according to another embodiment of the present invention.
Figure 24:
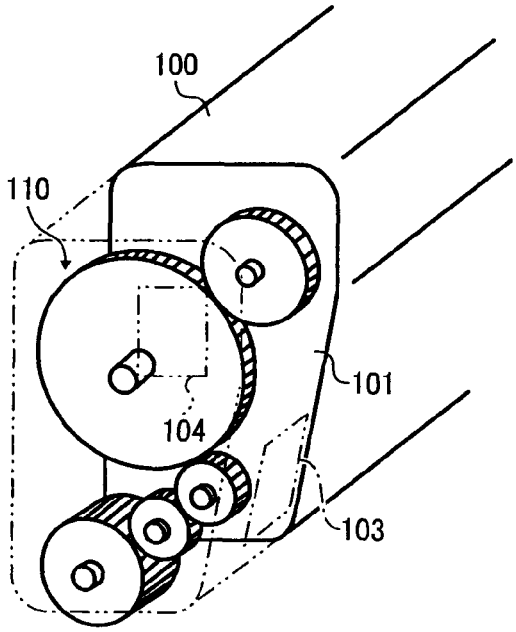
Figure 25:
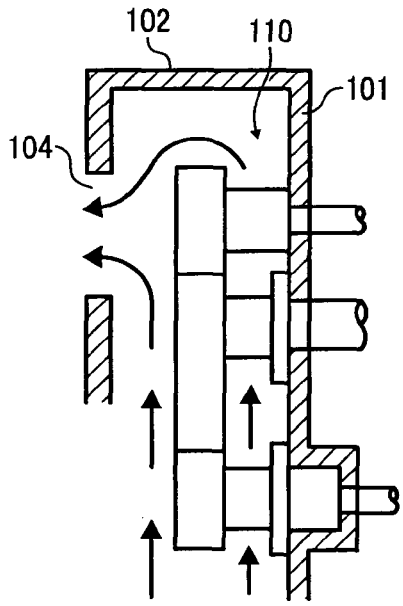
FIG. 25 is a cross section for explaining air flow in a gearbox.

FIGS. 23 and 24 are perspective views of a process cartridge 100 according to another embodiment of the present invention. The process cartridge 100 includes gears 110 that drive the photoconductor, and the developing roller. The gears 110 are covered by a side plate 102 provided outside of a side wall 101 of the process cartridge 100. At a surface of the side plate 102, an air inlet 103, formed in a substantially rectangular shape, is provided to a surface along the side surface of the process cartridge, in its longitudinal direction. An air outlet 104 is provided at a surface in a short side direction. The air outlet 104 is communicated with the passage 17, in which the fan motor 18 shown in FIG. 12 or 17 is provided. By driving the fan motor 18, as shown in FIG. 25, the air enters the gearbox from the air inlet 103. When the air flows towards the air outlet 104 along the gears 110, a passage that cools bearings hidden behind back surfaces of the gears, or the side wall 101, and sliding units of the gears can be formed.

Figure 26:
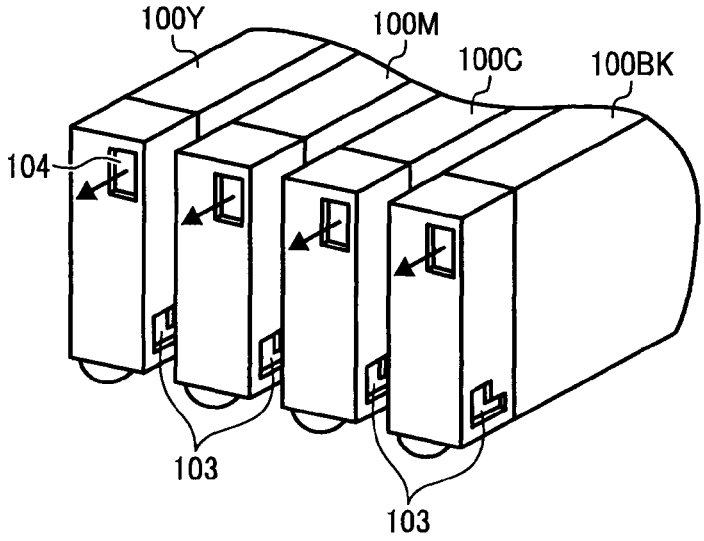
FIG. 26 is a perspective view of the process cartridge shown in FIG. 23 mounted on the image forming apparatus.

In the color image forming apparatus, the process cartridge 100, as shown in FIG. 26, is made by closely arranging four process cartridges 100Y, 100M, 100C, and 100BK in parallel. The four process cartridges 100Y, 100M, 100C, and 100BK respectively form the yellow toner image, the magenta toner image, the cyan toner image, and the black toner image. The process cartridge 100 being used in such an arrangement is too close to a wall surface of an adjacent process cartridge 100 opposed to the air inlet 103. Therefore, it may be difficult to take the air in from the air inlet 103.

Figure 27:
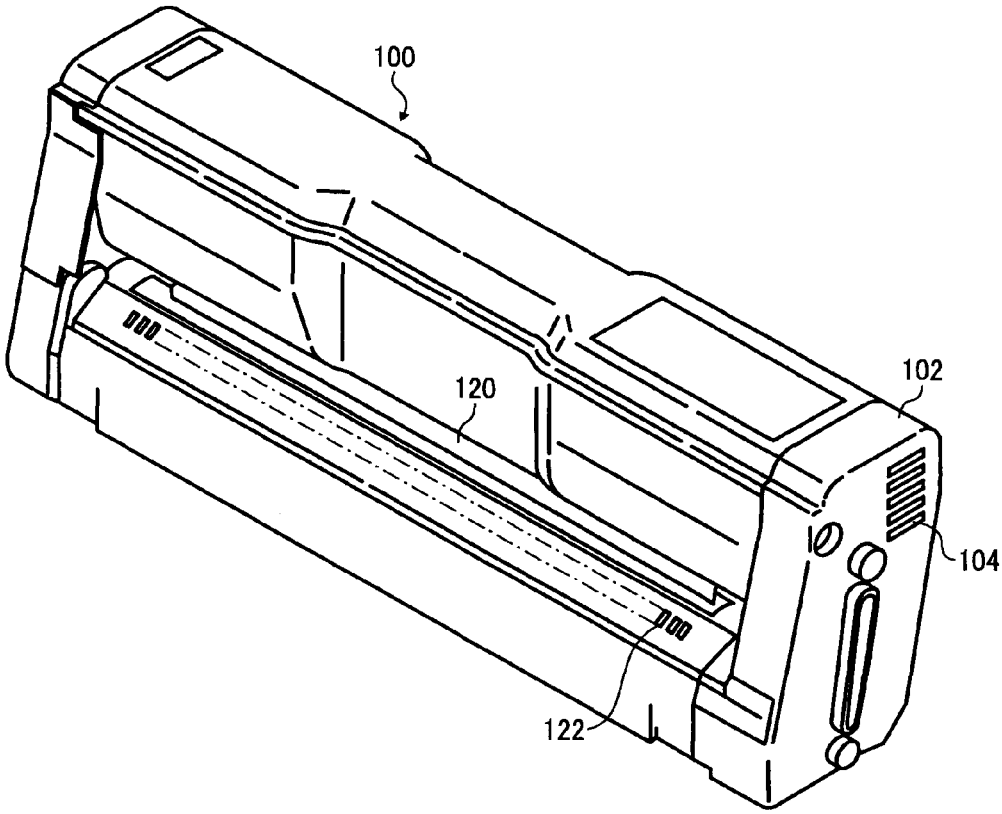
FIG. 27 is an external perspective view of the process cartridge.
Figure 28:
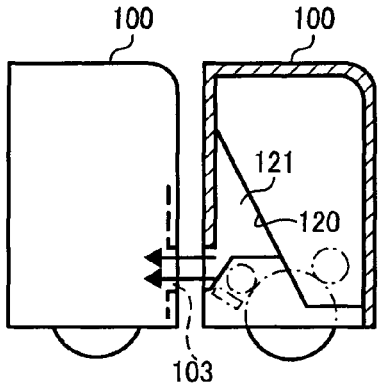
FIG. 28 is a cross section for explaining a space between process cartridges.
Figure 29:
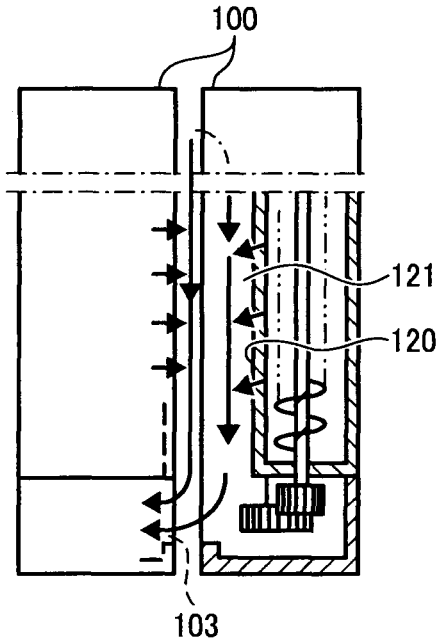
FIG. 29 is a cross section as viewed from the top of the process cartridges shown in FIG. 28.

FIG. 27 is an external perspective view of the process cartridge 100. The process cartridge 100 is formed, as shown in FIG. 27, in a substantially rectangular shape. A groove 120 having a V-shaped cross section is formed in the entire length of the process cartridge 100 in a longitudinal direction, excluding both side plates 102. A part of the groove 120, as shown in FIGS. 28 and 29, is opposed to the air inlet 103 of the adjacent process cartridge 100. Accordingly, a space 121 is formed between walls of the adjacent process cartridges 100 and components of the image forming apparatus. As a result, it is facilitated to take the air in from the air inlet 103.

The air flows along the space 121 formed by the groove 120 having a length substantially equal to the entire length of the process cartridge 100 in the longitudinal direction. As a result, the entire process cartridge 100 can be cooled. Therefore, the groove 120 can cool around a location where the toner is interposed, such as a toner storing unit.

Figure 30:
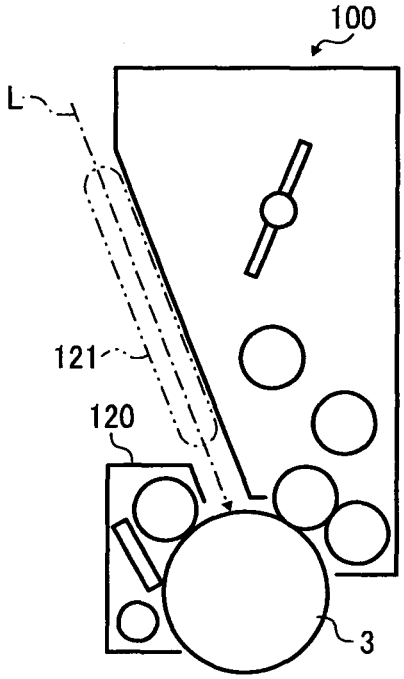
FIGS. 30 and 31 are schematic diagrams for explaining the space between the process cartridges.

As shown in FIG. 30, the space 121 formed by the groove 120 can be used as a space for an exposing passage.

Figure 31:
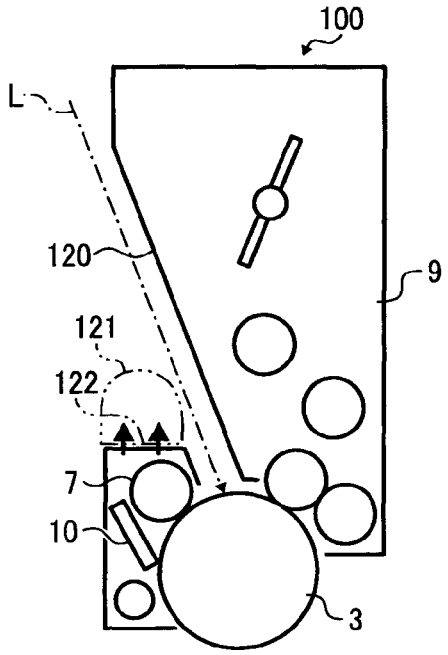

The groove 120, as shown in FIG. 31, is above the charging roller 7. Therefore, when a barrier above the charging roller 7 is formed with a sealing member 122 with a collection of a plurality of holes, substances generated from an adhesive can be discharged out of the process cartridge. Such adhesive is used to fix a metal member and an elastic material upon manufacturing the charging roller 7. When the photoconductor 3 is exposed in an atmosphere filled with such substances, compounds generated in the atmosphere may adhere on the photoconductor 3, thereby causing an abnormal image such as the one with a white spot. However, according to the embodiment, the substances can be easily discharged because of the space 121 serving as an airflow passage.

As shown in FIG. 31, the space 121 is also an upper space of the cleaning device 10. By providing the sealing member 122, the substances generated from the adhesive used for fixing the metal member and the elastic material can be discharged outside of the process cartridge upon manufacturing the cleaning device.

Figure 32:
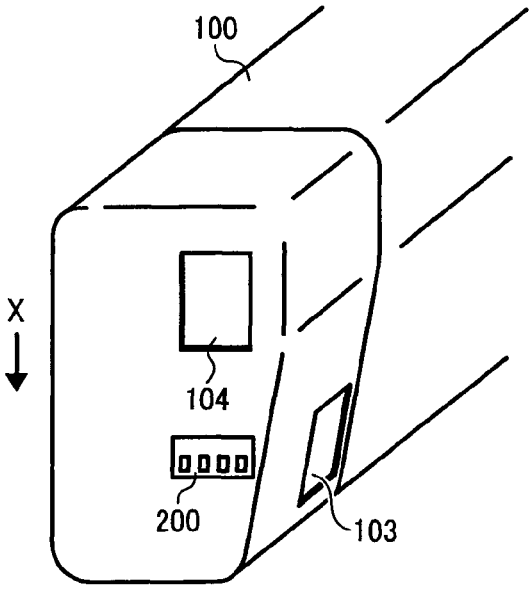
FIG. 32 is an external perspective view of an electrical contact of the process cartridge.
Figure 33:
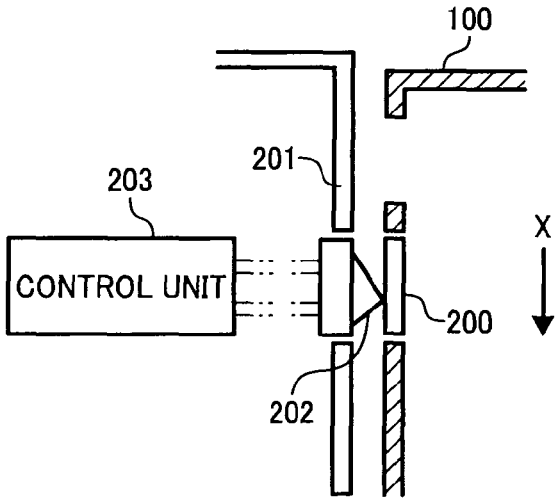
FIG. 33 is a cross section for explaining a relation between the electrical contact and a connection terminal.

The process cartridge 100 includes, as shown in FIG. 32, an electrical contact 200 such as IC chip. The electrical contact 200 supplies high voltage of 200 volts to 1000 volts to the charging roller 7 and the developing roller 90. The electrical contact 200 is also a power supplying unit and the like to a nonvolatile memory that records usage and the like of the process cartridge 100. As shown in FIG. 33, when the process cartridge 100 is mounted on the body, the electrical contact 200 is brought into contact with a contact terminal 202 fitted to a body frame 201 of the image forming apparatus. The contact terminal 202 is connected to a control unit 203 that reads/writes information from/to the nonvolatile memory or a high-voltage applying unit in the body 1.

The electrical contact 200 shown in FIGS. 32 and 33 is arranged under the air outlet 104 with respect to a mounting direction X of the process cartridge 100. Accordingly, a process cartridge with high operability can be provided, without having the contact terminal 202 on the body side caught by the air outlet 104. Particularly, when the electrical contact 200 is used as the power supplying unit for the nonvolatile memory, a contact region becomes narrow. Thus, the contact terminal 202 is reduced in size. This causes the contact terminal 202 to be easily caught even with a slight unevenness and prone to break. Therefore, the arrangement is preferred.

Figure 34:
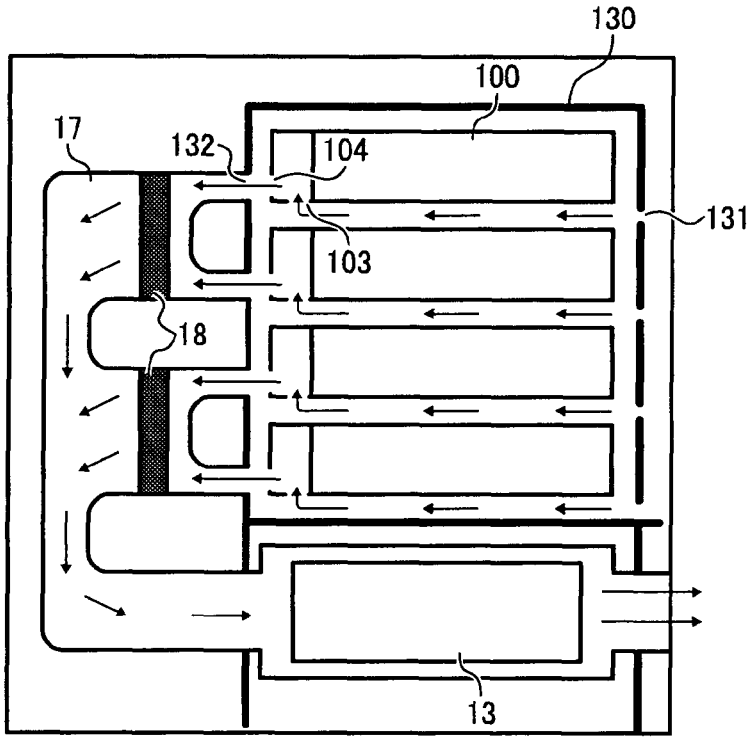
FIGS. 34 and 35 are plan views of the process cartridge mounted on the color image forming apparatus for explaining arrangement of the air inlet and the air outlet.
Figure 35:
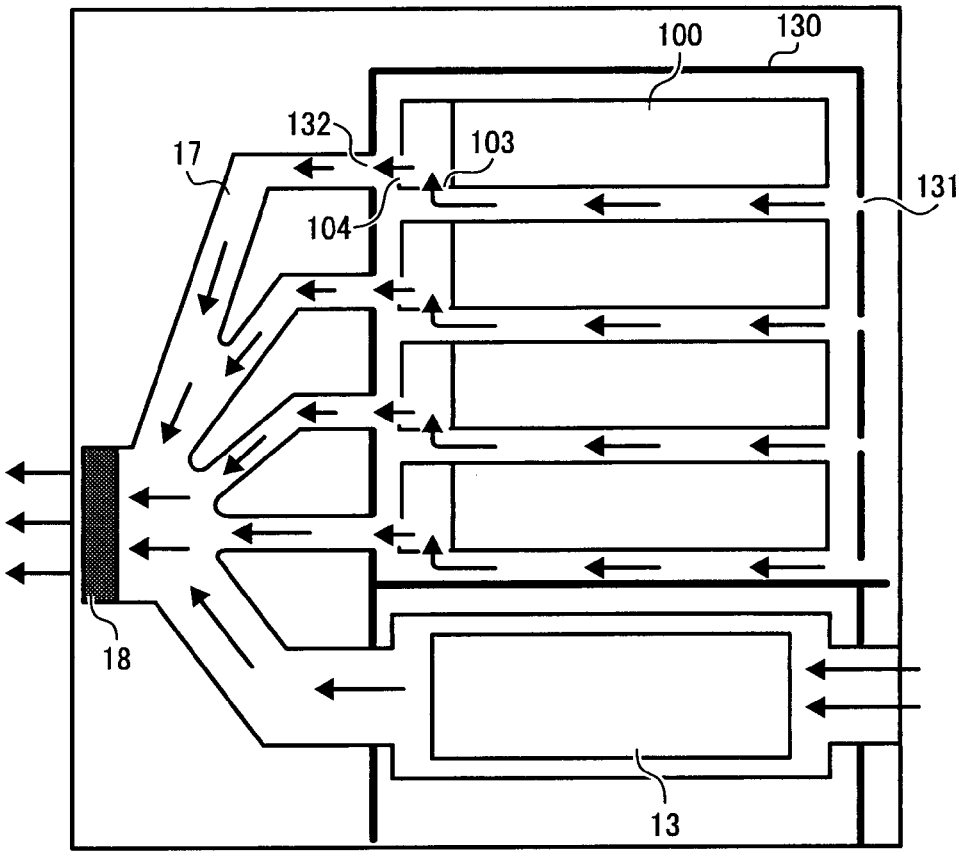

FIGS. 34 and 35 are plan views of the process cartridge 100 mounted on the body 1. What is shown in FIGS. 34 and 35 is essentially the same as that shown in FIGS. 16 and 17, except that the process cartridge 100 and the fixing device 13 are separated by a frame 130. The frame 130 includes an intake opening 131. The intake opening 131 is communicated with the space 121 between the adjacent process cartridges or the components of the image forming apparatus. The frame 130 also includes an exhaust opening 132 that is communicated with the passage 17 including the fan motor 18 at a position opposed to the air outlet 104.

By operating the fan motor 18, the outside air taken in from the intake opening 131 flows in the longitudinal direction of the process cartridge 100 and within the driving unit. Thus, it is possible to cool the entire process cartridge in the longitudinal direction, without forming a special air passage. This is because the space 121 between the adjacent process cartridges 100 or the components of the image forming apparatus is made into the flow passage.

In a general image forming apparatus, to save space, a driving device such as a motor and a power source device that generate heat are arranged at a side where the process cartridge driving unit is arranged. Because the exhaust opening 132 is provided to a surface opposed to the air outlet 104, the outside air can be secured from a side with less heat generation. Accordingly, the flow passage can be formed towards the side with more heat generation. Also, as shown in FIGS. 34 and 35, it is preferable to arrange the exhaust opening 132 provided to the frame 130 at a position corresponding to the air outlet 104. Similarly, although not shown, it is preferable to arrange the intake opening 131 also at a location corresponding to a space between the adjacent process cartridges 100, or the components of the image forming apparatus. As a result, a smooth flow passage can be formed, thereby suppressing the amount of airflow and speed loss in the passage.

According to an embodiment of the present invention, the heat generated at gear engagement and a bearing sliding unit can be removed. Moreover, because toner deterioration and the like caused by heat can be reduced, a high-quality image can be formed stably.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge for an image forming apparatus, comprising:

a photoconductor;

a charging roller;

a cleaning device;

a developing device;

an agitator;

a plurality of agitating rollers;

a toner supply roller;

a plurality of gears including, a first gear configured to drive the photoconductor;

a second gear configured to drive the charging roller, a third gear configured to drive the developing device, a fourth gear configured to drive the agitator, a fifth gear configured to drive the toner supply roller; and a gearbox configured to house the plurality of gears, wherein the gear box is provided with, an air inlet located on a first surface facing a second adjacent process cartridge;

an air outlet, wherein the plurality of gears are disposed between the air inlet and the air outlet, wherein the air flows along the plurality of gears in the gearbox to cool down the plurality of gears; and a groove that extends along a substantially entire longitudinal length of the process cartridge, the groove being located on a second surface opposite to the first surface, part of the groove being communicated with an air inlet of a the second adjacent process cartridge, wherein the process cartridge is configured to be closely arranged in parallel with another process cartridge in the image forming apparatus.

2. The process cartridge according to claim 1, wherein at least one of the air inlet and the air outlet includes a plurality of holes.

3. The process cartridge according to claim 1, further comprising a filter that covers at least one of the air inlet and the air outlet.

4. The process cartridge according to claim 1, further comprising a shielding member that is movable to an open position and a closed position in response to attachment and detachment of the process cartridge, and shields at least one of the air inlet and the air outlet.

5. The process cartridge according to claim 1 wherein, the path of the airflow is substantially sealed.

6. The process cartridge according to claim 1, wherein the air outlet is located above the air inlet in a gravity direction when the process cartridge is mounted on the image forming apparatus.

7. The process cartridge according to claim 1, wherein the air inlet is located on a longitudinal-side surface of the process cartridge, and the air outlet is located on a short-side surface of the process cartridge.

8. The process cartridge according to claim 1, wherein the rotator is an image carrier that carries a toner image, and the groove is communicated with an exposing passage through which light to be exposed to the image carrier passes.

9. The process cartridge according to claim 8, further comprising a charging device that charges a surface of the image carrier with a predetermined polarity, wherein the groove is communicated with a side of the charging device.

10. The process cartridge according to claim 9, further comprising a cleaning device that removes residual toner from the image carrier, wherein the groove is communicated with a side of the cleaning device.

11. The process cartridge according to claim 10, further comprising a sealing member with a plurality of openings, which is located on the charging device and the cleaning device.

12. The process cartridge according to claim 1, wherein the air inlet and the air outlet are located on different surfaces, the process cartridge further comprising:

an electrical contact that is configured to electrically communicate with the image forming apparatus, and is located on a surface where the air outlet is located.

13. An image forming apparatus comprising:

a process cartridge according to claim 1; and a space that is substantially sealed and is communicated with outside via an intake opening and an exhaust opening.

14. The image forming apparatus according to claim 13, further comprising a fan motor that is located near the exhaust opening in the space.

15. The image forming apparatus according to claim 13, further comprising a frame that forms the space to accommodate the process cartridge, and includes the intake opening and the exhaust opening.

16. The image forming apparatus according to claim 13, wherein the process cartridge is spaced apart from an adjacent process cartridge or another component of the image forming apparatus when the process cartridge is mounted on the image forming apparatus.

17. The image forming apparatus according to claim 13, wherein the process cartridge includes a plurality of process cartridges, and the air outlet and the air inlet of adjacent process cartridges are closely opposed to each other.

18. The image forming apparatus according to claim 17, further comprising a fixing unit that is located on an air-outlet side in a direction connecting the air outlet and the air inlet that does not face each other when the air outlet and the air inlet of adjacent process cartridges are set to be opposed to each other.

* * * * *